US006716011B2

(12) United States Patent
Bhagavatula

(10) Patent No.: US 6,716,011 B2
(45) Date of Patent: Apr. 6, 2004

(54) HYDRAULIC PUMP UTILIZING FLOATING SHAFTS

(75) Inventor: Srinivas Bhagavatula, Kentwood, MI (US)

(73) Assignee: Monarch Hydraulics, Inc., Grand Rapids, MI (US)

( * ) Notice: Subject to any disclaimer, the term of this patent is extended or adjusted under 35 U.S.C. 154(b) by 0 days.

(21) Appl. No.: 09/882,405

(22) Filed: Jun. 14, 2001

(65) Prior Publication Data

US 2003/0044298 A1 Mar. 6, 2003

(51) Int. Cl.[7] ..... F01C 1/18

(52) U.S. Cl. ..... 418/206.1; 418/102; 418/182; 418/270

(58) Field of Search ..... 418/206.1, 102, 418/182, 270

(56) References Cited

U.S. PATENT DOCUMENTS

| | | | |
|---|---|---|---|
| 1,682,842 | A | 9/1928 | Hamer |
| 2,391,072 | A | 12/1945 | Pugh |
| 2,479,077 | A | 8/1949 | McAlvay |
| 2,571,377 | A | 10/1951 | Olah |

(List continued on next page.)

FOREIGN PATENT DOCUMENTS

| | | | |
|---|---|---|---|
| FR | 2436889 | * 5/1980 | ..... 418/102 |
| GB | 322778 | * 12/1929 | ..... 418/102 |
| SU | 1770593 | * 10/1992 | ..... 418/102 |

*Primary Examiner*—Thomas Denion
*Assistant Examiner*—Theresa Trieu
(74) *Attorney, Agent, or Firm*—Price, Heneveld, Cooper, DeWitt & Litton

(57) ABSTRACT

A hydraulic pump assembly includes a pump housing having a chamber defined therein, wherein the chamber includes a pair of cylindrically shaped portions each defining at least one end wall. The hydraulic pump assembly also includes a pair of rotary pump elements disposed for rotation within the cylindrically shaped portions of the chamber, and which cooperate to create a hydraulic pressure. The hydraulic pump assembly further includes a pair of cylindrically shaped shafts each having at least one end wall, and disposed within the pair of cylindrically shaped portions of the chamber and within the pair of pump elements. The shafts are fixed for rotation and are axially shiftable with respect to the pump elements. A hydraulic fluid within the chamber stabilizes at least one of the axially shiftable shafts such that the end face of the shaft is spaced from the end wall of the cylindrically shaped portion of the chamber when the hydraulic pump is in use.

13 Claims, 4 Drawing Sheets

U.S. PATENT DOCUMENTS 2,842,065 A 7/1958 Lease
2,885,965 A 5/1959 Haberland
2,891,483 A 6/1959 Murray et al.
2,965,040 A 12/1960 Eisenberg
2,990,783 A 7/1961 Oliver
3,063,378 A 11/1962 Hart
3,076,413 A 2/1963 Hoffer
3,096,720 A * 7/1963 Younger ..... 418/102
3,156,191 A 11/1964 Lauck
3,263,425 A * 8/1966 Rohde ..... 418/206.1
3,292,550 A * 12/1966 Gordon ..... 418/102
3,306,225 A 2/1967 Smith
3,447,472 A 6/1969 Hodges et al.
3,482,524 A 12/1969 Marietta
3,490,382 A 1/1970 Joyner
3,644,071 A 2/1972 Schultheis
3,671,155 A 6/1972 Dubinsky
3,690,793 A 9/1972 Pollman et al.
3,909,165 A 9/1975 Laumont
4,005,952 A 2/1977 Morisaki
4,090,820 A 5/1978 Teruyama
4,160,630 A 7/1979 Wynn
4,245,969 A 1/1981 Caslow et al.
4,265,602 A 5/1981 Teruyama
4,395,207 A 7/1983 Manttari et al.
4,470,776 A 9/1984 Kostek et al.
4,548,557 A * 10/1985 Janczak ..... 418/76
4,553,915 A 11/1985 Eley
4,859,161 A 8/1989 Teruyama et al.
4,927,343 A 5/1990 Lonsberry
5,190,450 A * 3/1993 Ghosh et al. ..... 418/102
5,641,281 A 6/1997 Russell et al.
5,702,234 A 12/1997 Pieters
5,810,571 A 9/1998 Cross et al.
6,135,741 A 10/2000 Oehman, Jr.
6,152,715 A 11/2000 Kaempe et al.

* cited by examiner

HYDRAULIC PUMP UTILIZING FLOATING SHAFTS

BACKGROUND OF THE INVENTION

The present invention relates to hydraulic pumps, and in particular to fixed clearance hydraulic pumps of the type including a pair of inter-engaging rotary pump elements such as gears and the like.

High pressure hydraulic pumps that include gear-type rotary pump elements are well-known and typically include a pump housing having a gear chamber therein that is in fluid communication with an inlet and an outlet. In addition, these pumps typically include a pair of parallel shafts journaled within the gear chamber and each including a meshing gear fixedly attached or integrally molded therewith. One of the shafts constitutes an idler shaft that is completely disposed within the housing, while at least one end of the other shaft extends outwardly from the housing for connection with a motor unit or other apparatus for imparting rotary motion to the pump.

Heretofore, the gears were typically fixedly attached by means such as locking rings and/or integrally molded with an associated shaft, thereby affecting the size of the gear and the associated shaft. One detrimental effect of utilizing the locking ring to attach each gear to an associated shaft is the associated decrease in the leak path of the gear, thereby effecting the overall efficiency of the pump. Further, these designs are significantly complex, thereby adding to manufacturing costs.

SUMMARY OF THE INVENTION

One aspect of the present invention is to provide a hydraulic pump assembly that includes a pump housing having a chamber defined therein, wherein the chamber includes a pair of cylindrically shaped portions each defining at least one end wall, the housing includes an inlet port and an outlet port in fluid communication with the chamber. The hydraulic pump assembly also includes a pair of rotary pump elements disposed for rotation within the cylindrically shaped portions of the chamber, wherein the pair of pump elements cooperate to create a hydraulic pressure. The hydraulic pump assembly further includes a pair of cylindrically shaped shafts each having at least one end face, and disposed within the pair of cylindrically shaped portions of the chamber and within the pair of pump elements. The shafts are fixed for rotation and axially shiftable with respect to the pump elements. A hydraulic fluid within the chamber stabilizes at least one of the axially shiftable shafts such that the end face of the shaft is spaced from the associated end wall of the cylindrically shaped portion of the chamber when the hydraulic pump is in use.

Another aspect of the present invention is to provide a hydraulic pump assembly that includes a pump housing having a chamber defined therein, wherein the housing includes an inlet port, an outlet port, and at least one circulation port in fluid communication with the chamber, and wherein the chamber includes a pair of cylindrically shaped portions each having at least one end wall. The hydraulic pump assembly also includes a pair of rotary pump elements each having a central bore extending therethrough, and a plurality of meshing teeth, wherein the pump elements are disposed for rotation within the chamber, and wherein the pair of pump elements cooperate to create a hydraulic pressure within a portion of the chamber. The hydraulic pump further includes a pair of cylindrically shaped shafts each having at least one end surface, and disposed within the chamber and within the central bores of the pump elements. The shafts are fixed for rotation and linearly translatable with respect to the pump elements. A hydraulic fluid within the hydraulic pump assembly stabilizes at least one linearly translatable shaft such that the end face of the shaft is spaced apart from the associated end wall of the cylindrically shaped portions of the chamber when the pump assembly is in use.

The present inventive hydraulic pump assembly provides a hydraulic pump having an uncomplicated design, that reduces costs associated with manufacturing, assembly and maintenance. In addition, the hydraulic pump assembly is more readily adapted to be reduced in overall size while still providing a significantly high pump efficiency.

These and other features, advantages and objects of the present invention will be further understood and appreciated by those skilled in the art by reference to the following specification, claims and appended drawings.

DETAILED DESCRIPTION OF PREFERRED EMBODIMENT

Figure 1:
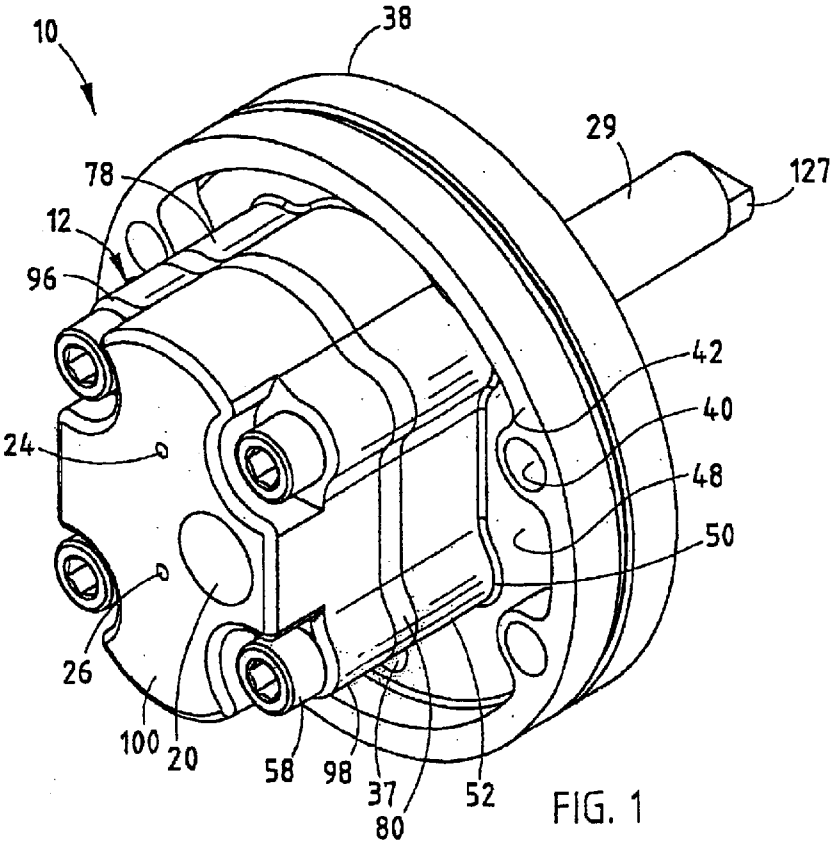
FIG. 1 is a perspective view of a hydraulic pump assembly embodying the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

Figure 3:
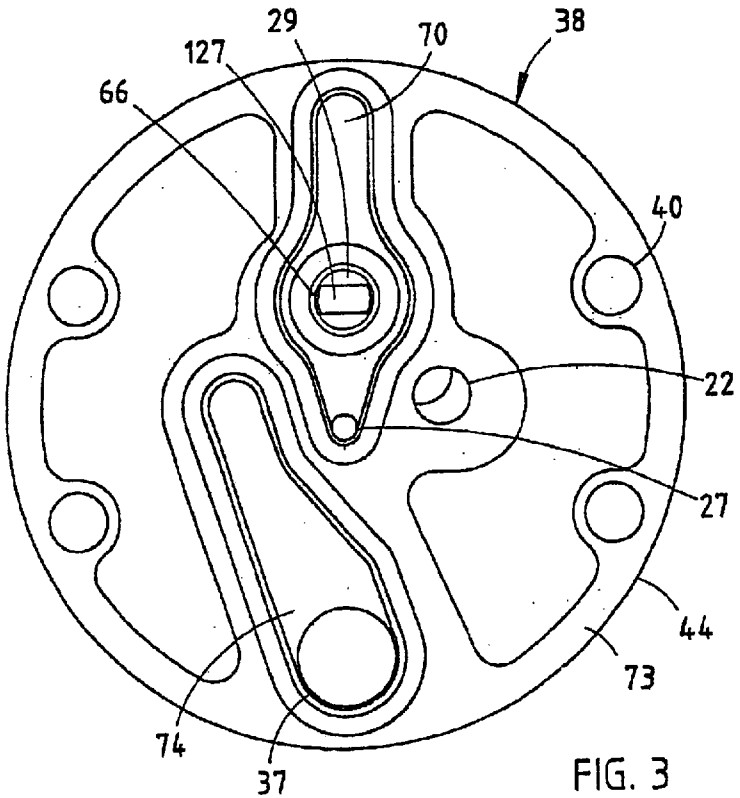
FIG. 3 is a rear side view of the hydraulic pump assembly.
Figure 2:
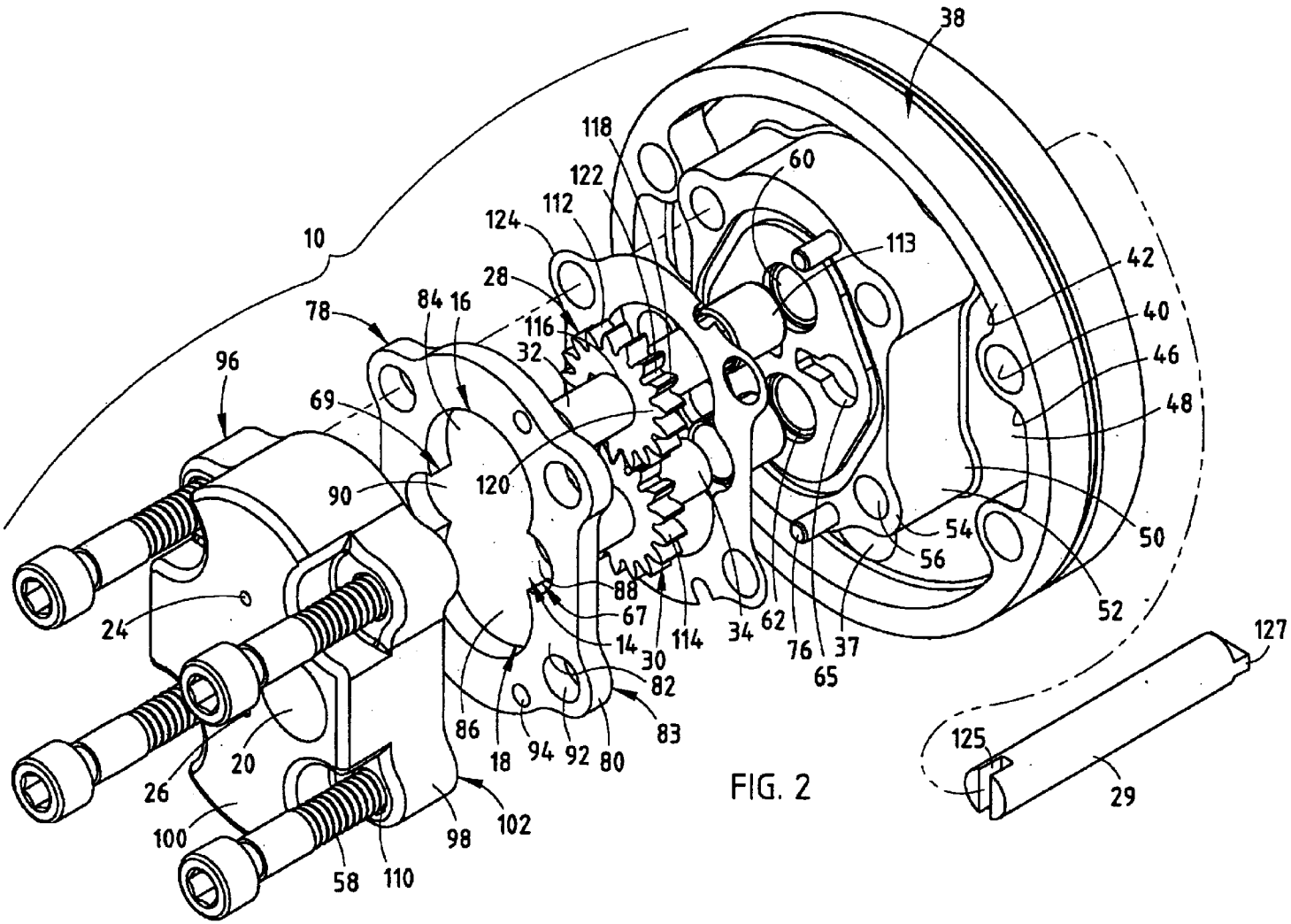
FIG. 2 is an exploded perspective view of the hydraulic pump assembly.
Figure 5:
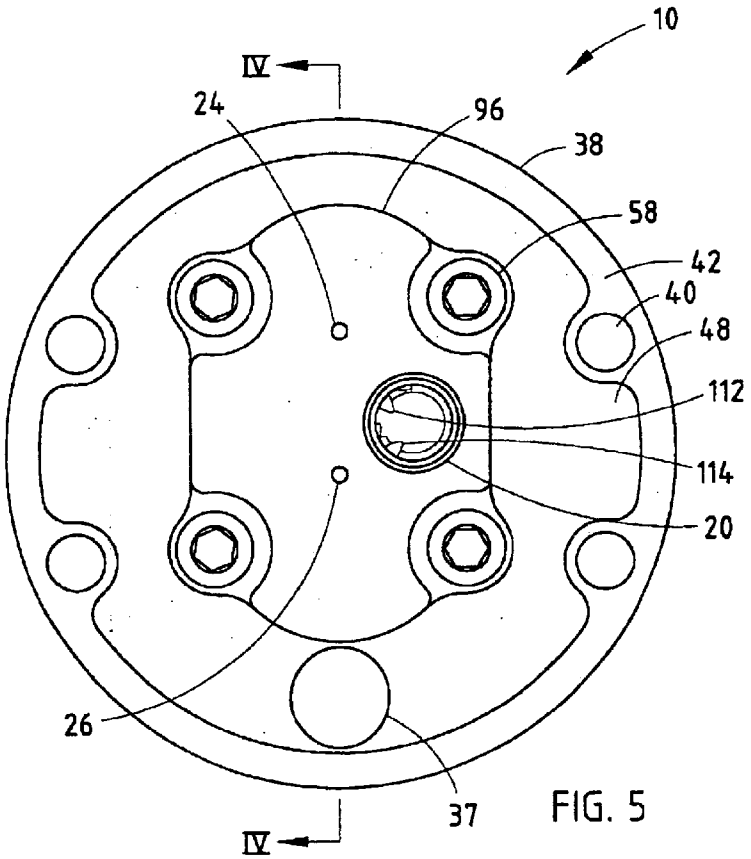
FIG. 5 is a front side view of the hydraulic pump assembly.
Figure 4:
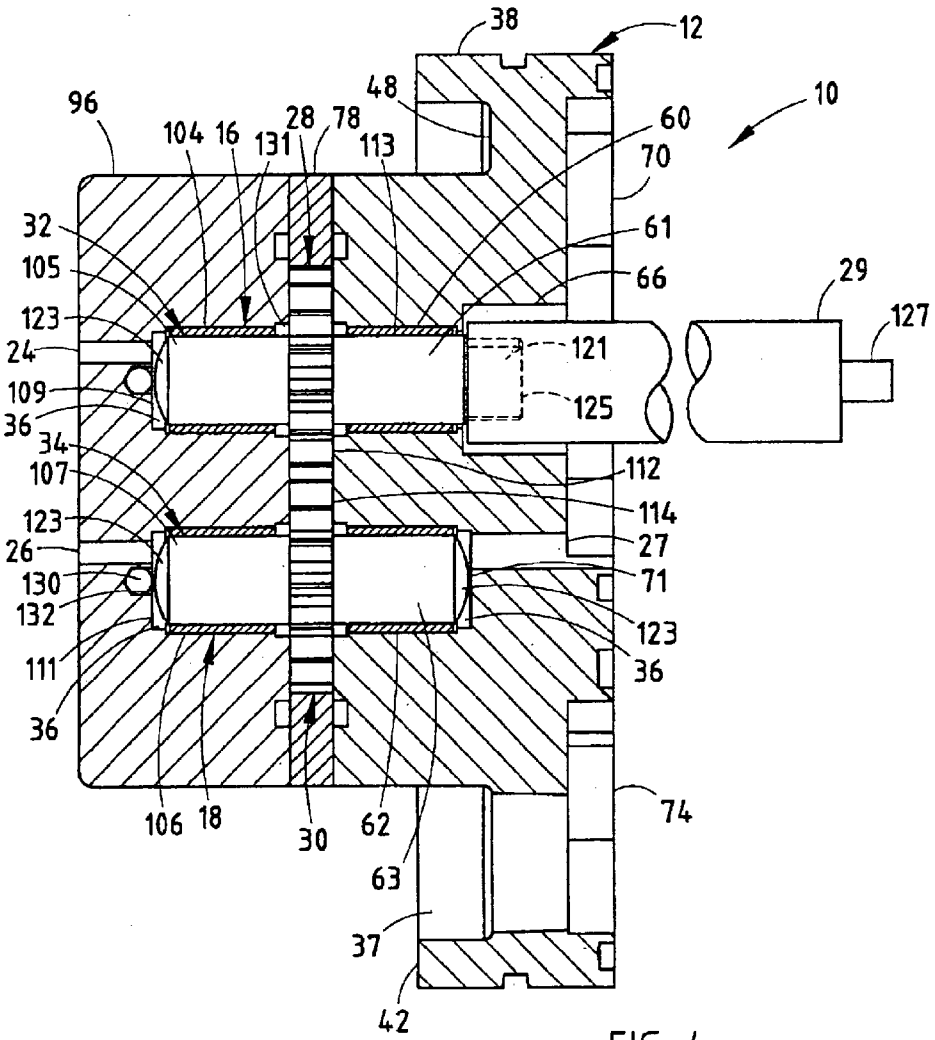
FIG. 4 is a cross-sectional view of the hydraulic pump assembly, taken along the line IV—IV, FIG. 5.

The reference number 10 (FIG. 1) generally designates a hydraulic pump assembly embodying the present invention. In the illustrated example, pump assembly 10 includes a pump housing 12 defining a chamber 14 (FIG. 2) therein. The chamber 14 includes a first cylindrically shaped portion 16 and a second cylindrically shaped portion 18. The housing 12 includes an inlet port 20 and an outlet port 22 (FIG. 3) each in fluid communication with chamber 14. Housing 12 further includes a first circulation port 24, a second circulation port 26 and a third circulation port 27, wherein first circulation port 24 is in fluid communication with first portion 16 of chamber 14, and second and third circulation ports 26 and 27 are in fluid communication with second portion 18 of chamber 14. Hydraulic pump assembly 10 further includes a first rotary pump element 28 and a second rotary pump element 30 disposed for rotation within first portion 16 and second portion 18 of chamber 14, respectively. The pump elements 28 and 30 cooperate to create a hydraulic pressure within chamber 14 of housing 12. Hydraulic pump assembly 10 further includes a drive shaft 32 and an idler shaft 34 disposed within portions 16 and 18 of chamber 14 and within pump elements 28 and 30. Drive shaft 32 and idler shaft 34 are fixed for rotation with respect to pump elements 28 and 30, respectively, and are further axially shiftable or linearly translatable with respect to pump elements 28 and 30. Drive shaft 32 and idler shaft 34 are axially supported by hydraulic fluid located within pockets 36 (FIG. 4) as described below.

In operation, and as described further below, inlet port 20 of housing 12 is in fluid communication with a source of hydraulic fluid such as a reservoir (not shown). The hydraulic fluid is drawn into chamber 14 via inlet port 20 by the rotational motion of pump elements 28 and 30 as drive shaft 32 is driven in rotation by a motor unit, or other source or other apparatus for imparting rotary motion to the pump, via an intermediate shaft 29. The hydraulic fluid is then forced outward from chamber 14 under hydraulic pressure via outlet port 22, which is in fluid communication with a system that utilizes the hydraulic pressure (not shown). The hydraulic fluid is then returned to the reservoir via a hydraulic fluid return port 37 that is in fluid communication with the reservoir.

The housing 12 of pump assembly 10 includes a circularly shaped wear plate 38. Wear plate 38 includes a plurality of apertures 40 spaced about a periphery of wear plate 38 and adapted to receive mounting hardware (not shown) therein to secure housing 12 of pump assembly 10 to the system utilizing the increased hydraulic pressure generated by pump assembly 10 and as provided through outlet port 22. Wear plate 38 is defined by a first side 42 and an oppositely facing second side 44. First side 42 includes a recessed area 46 that defines a recessed wall 48. Wear plate 38 also includes a portion 50 protruding outwardly from recessed wall 48. Portion 50 of wear plate 38 is defined by an outwardly extending wall 52 that extends substantially perpendicular to recessed wall 48, and a mating surface 54 that is substantially parallel with recessed wall 48. Portion 50 of wear plate 38 includes a plurality of inwardly extending, threaded apertures 56 that are adapted to threadably receive a plurality of bolts 58 therein, thereby securing sections of housing 12 together. Portion 50 of wear plate 38 further includes a first bore 60 and a second bore 62, having an end wall 71, adapted to receive a first end 61 of drive shaft 32 and a first end 63 of idler shaft 34 therein, respectively. Portion 50 of wear plate 38 further includes an end chamber 65 forming the end of an inlet chamber 67, and an intermediate shaft bore 66 that extends between second side 44 of wear plate 38 and first bore 60. Second side 44 of wear plate 38 includes a mounting surface 73 that extends about the periphery of wear plate 38 and further divides numerous apertures defined therein. Specifically, mounting surface 73 defines a first recessed area 70 that provides fluid communication between the hydraulic fluid reservoir and both the intermediate shaft bore 66 and circulation port 27. Mounting surface 73 further defines a second recessed area 74 surrounding and in fluid communication with return port 37.

The wear plate 38 of housing 12 also includes a pair of alignment pins 76 extending outwardly from mating surface 54 of portion 50. Alignment pins 76 are utilized to align sections of housing 12 as housing 12 is assembled, and as described below.

The housing 12 also includes a cylinder plate or body 78 having a similar cross-sectional shape to that of portion 50 of wear plate 38, and is defined by an outer wall 80, a first mating surface 82 and a second mating surface 83 opposite first mating surface 82. Cylinder plate 78 includes a first circularly shaped passage 84 and a second circularly-shaped passage 86 that extend between first and second mating surfaces 82 and 83 of cylinder plate 78 and are adapted to rotatably receive first pump element 28 and second pump element 30 therein, respectively. First passage 84 and second passage 86 are in fluid communication with one another and cooperate to form a figure-8 shaped cross-sectional geometry. Cylinder plate 78 also includes an inlet passage 88 extending between first and second mating surface 82 and 83, and forming a portion of inlet chamber 67, and an outlet passage 90 extending between first and second mating surfaces 82 and 83 and forming a portion of an outlet chamber 69. Cylinder plate 78 further includes a plurality of apertures 92 adapted to receive bolts 58 therein and co-located with apertures 56 of wear plate 38 when housing 12 is assembled. Cylinder plate 78 further includes a pair of apertures 94 extending between first and second mating surfaces 82 and which are adapted to receive alignment pins 76 of wear plate 38 therein, thereby providing alignment between cylinder plate 78 and wear plate 38 during assembly of housing 12.

The housing 12 of pump assembly 10 further includes a suction or port plate 96 defined by an outer wall 98, an end wall 100, and a mating surface 102. Suction plate 96 is provided with a cross-sectional shape that is similar to that of portion 50 of wear plate 38. Suction plate 96 includes a first bore 104, having an end wall 109, and a second bore 106, having an end wall 111, adapted to receive a second end 105 of drive shaft 32 and a second end 107 of idler shaft 34 therein, respectively. Circulation ports 24 and 26 extend from end wall 100 of suction plate 96 to bores 104 and 106, respectively. Inlet port 20 extends between end wall 100 and mating surface 102 and is concentrically located with inlet passage 88 of cylinder plate 78 when housing 12 is assembled. Suction plate 96 is further provided with a plurality of apertures 110 adapted to receive bolts 58 therein and which are co-located with apertures 92 of cylinder plate 78 and apertures 56 of wear plate 38 when housing 12 is assembled.

The first and second pump elements 28 and 30 include a drive gear 112 and an idler gear 114, respectively. As drive gear 112 and idler gear 114 are similar in construction in relation to their respective shafts 32 and 34, the description of drive gear 112 should be considered descriptive of both drive gear 112 and idler gear 114. Drive gear 112 includes a central aperture 116 and a plurality of teeth 118 extending about a periphery thereof. Drive gear 112 further includes a leak path 120 which is defined as the distance between aperture 116 and the roots 122 of teeth 118. Gears 112 and 114 are keyed for rotational movement with respect to shafts 32 and 34 via keys 131, respectively. Gears 112 and 114 are not fixedly attached to shafts 32 and 34, thereby allowing shafts 32 and 34 to translate linearly with respect to gears 112 and 114.

The first end 61 of drive shaft 32 includes a wedge section 121 adapted to mate with intermediate shaft 29. Wedge section 121 is provided a substantially rectangular cross-sectional area. First end 63 and second end 107 of idler shaft 34, as well as second end 105 of drive shaft 32 each include a chamfered or rounded end face 123.

As pump assembly 10 operates, and as described further below, some of the hydraulic fluid that is forced between gears 112 and 114 leaks along the leak path 120 of each gear 112 and 114, and lubricates bearing 113. The overall efficiency of pump assembly 10 is, in part, maximized by maximizing the leak path 120 of each gear 112 and 114 to minimize oil blow-back into bores 60, 62, 104 and 106 while minimizing the overall size of gears 112 and 114. This is accomplished within pump assembly 10 by eliminating the retaining rings typically associated with the pump elements of hydraulic pumps. These retaining rings decrease pump efficiency by decreasing the leak path 120 of the pump elements, as well as by requiring increased tolerances due to manufacturing variances of the pump element components and the assembly thereof.

The intermediate shaft 29 couples drive shaft 32 with the motor unit (not shown), and includes a notched end 125 having a substantial rectangular cross-sectional area adapted to hingedly receive wedge section 121 of drive shaft 32 therein, and a wedge section 127 located at the opposite end of intermediate shaft 29. Wedge section 127 of drive shaft 29 has a rectangular cross-sectional area that extends substantially perpendicular to notched end 125. The wedge section/notched end connections between intermediate shaft 29 and drive shaft 32 allows pump assembly 10 to move with respect to the motor unit during operation without interrupting the connection therebetween.

In assembly, housing 12 is constructed by assembling wear plate 38, cylinder plate 78, and suction plate 96. Specifically, cylinder plate 78 is aligned with portion 58 of wear plate 38 by aligning alignment pins 76 of wear plate 38 with apertures 94 of cylinder plate 78. It should be noted that shim 124 is placed between second mating surface 83 of cylinder plate 78 and mating surface 54 of wear plate 38, thereby assuring proper operational clearance therebetween. Suction plate 96 is then aligned with cylinder plate 78. Bolts 58 are then positioned within apertures 110 of suction plate 96, apertures 92 of cylinder plate 78 and apertures 56 of wear plate 38, thereby securing wear plate 38, cylinder plate 78 and suction plate 96 in assembly with one another.

Prior to the addition of suction plate 96 to housing 12, drive shaft 32 and drive gear 112, a plurality of bushings or journal bearings 113, idler shaft 34 and idler gear 114 are placed within chamber 14 of housing 12 such that first end 61 of drive shaft 32 extends into first bore 60 of wear plate 38, first end 63 of idler shaft 34 extends into second bore 62 of wear plate 38, drive gear 112 is concentrically located within first passage 84 of cylinder plate 78 and idler gear 114 is concentrically located within second passage 86 of cylinder plate 78. Suction plate 96 is then positioned with respect to cylinder plate 78 such that second end 105 of drive shaft 34 extends into first bore 104 of suction plate 96 and second end 107 of idler shaft 34 extends into second bore 106 of suction plate 96.

In operation, a rotational force is exerted on drive shaft 34 by the motor unit (not shown) via intermediate shaft 29. As is well known in the art, the rotary motion and cooperation between power gear 112 and idler gear 114 create a suction pressure thereby drawing hydraulic fluid into inlet chamber 67 of housing 12 via inlet port 20. The hydraulic fluid is then forced into outlet chamber 69 by rotational movement of gears 112 and 114, and then out from housing 12 via outlet port 22 and into the system utilizing the increased hydraulic pressure. It should be noted that the operation of pump assembly 10 as described above, can be reversed by reversing the direction of rotation of gears 112 and 114 using suitably configured suction and wear plates. Fluid is then returned from the hydraulic system to the hydraulic fluid reservoir via hydraulic fluid return port 37. As hydraulic fluid is forced between gears 112 and 114, hydraulic fluid also leaks along the leak path 120 thereof, at a pressure that is different from both the inlet pressure and outlet pressure, and into first bores 60 and 104, and second bores 62 and 106 of chamber 14, thereby lubricating bearings 113. The hydraulic fluid traveling into bores 60, 62, 104 and 106 is typically referred to in the art as "leakage fluid." The hydraulic fluid subsequently leaks into the ends of bores 62, 104 and 106, and into pockets 36 between the end walls 71, 109 and 111 of bores 62, 104 and 106, and shafts 32 and 34, thereby keeping ends 123 of shafts 32 and 34 in spaced apart relation to end walls 71, 109 and 111 of bores 62, 104 and 106. The hydraulic fluid located within pockets 36 eliminates the necessity of mechanical elements to restrict the axial translation of shafts 32 and 34. The hydraulic fluid located within pockets 36 prevents shafts 32 and 34 from contacting housing 12, thereby reducing friction and increasing the overall efficiency of pump 10 for a given set of operating parameters such as outlet pressure and flow rate. Further, the free axial translation of shafts 32 and 34 with respect to gears 112 and 114 allows shafts 32 and 34 to be located to an optimum operating position for a given set of geometrical parameters.

Circulation ports 24, 26 and 27 allow the hydraulic fluid flowing through bores 62, 104 and 106, and into pockets 36, to circulate back into the hydraulic fluid reservoir after providing proper lubrication of bearings 113 and equalization of pressure within bores 62, 104 and 106. It should be noted that circulation ports 24, 26 and 27 are not concentrically located with their respective bores 104, 106 and 62, and are therefore off-center from shafts 32 and 34. This allows hydraulic fluid to flow through circulation ports 24, 26 and 27 even if chamfered ends 123 of shafts 32 and 34 should contact housing 12 during starting. The non-concentric location of the circulation ports 24, 26 and 27 within bores 104,106 and 102 further ensures that a sufficient amount of hydraulic fluid is present within pockets 36 during operation of pump 10. The size of circulation ports 24, 26 and 27 are sized so as to restrict the flow of hydraulic fluid from within pockets 36, thereby creating a "back-pressure" on the ends 123 of shafts 32 and 34. It should further be noted that the size of ports 24, 26 and 27 are functions of variables such as required pump capacity and flow rate variations.

In another embodiment, pump 10 includes a pair of bearings 130 located within a pair of pockets 132. In operation, bearings 130 support shafts 32 and 34 when pump 10 is oriented such that ends 105 and 107 of shafts 32 and 34 are located below ends 61 and 63. It should be noted that shafts 32 and 34 are set apart from bearings 130 when pump 10 is in operation and hydraulic fluid is traveling through housing 12. The bearings 130 support shafts 32 and 34 thereon during start-up and shut-down of pump 10.

Figures 6, 7:
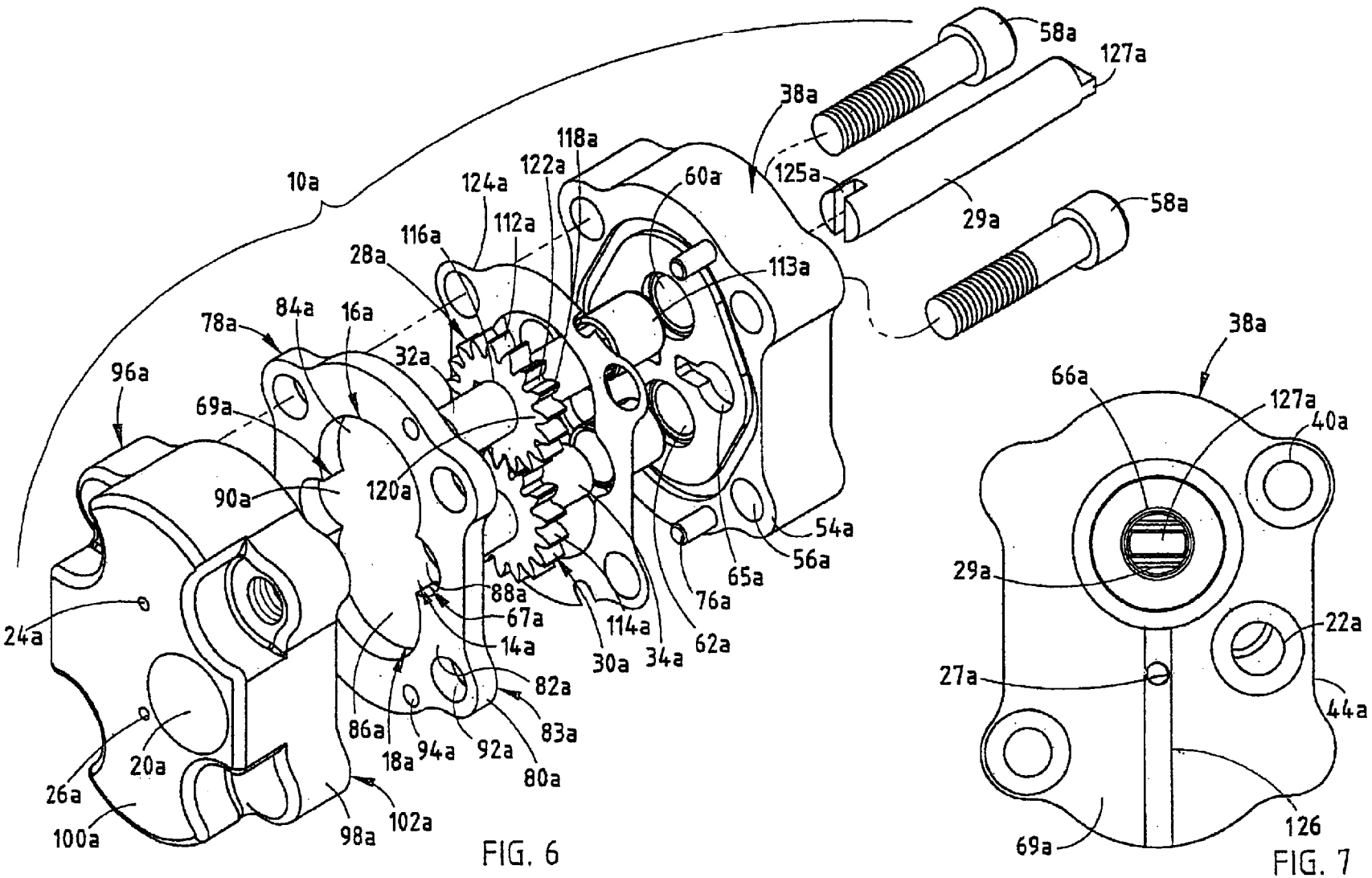
FIG. 6 is a perspective view of an alternative embodiment of the hydraulic pump assembly embodying the present invention.
FIG. 7 is a rear side view of the alternative embodiment of the hydraulic pump assembly.

The reference numeral 10*a* (FIGS. 6 and 7) generally designates another embodiment of the hydraulic pump. Since pump 10*a* is similar to the previously described pump 10, similar parts appearing in FIGS. 1 and 3 and FIGS. 6 and 7, respectfully, are represented by the same, corresponding reference numeral, except for the suffix "a" in the numeral of the latter.

The hydraulic pump 10*a* is similarly constructed and assembled as the hydraulic pump 10, with the most notable exception being the replacement of wear plate 38 with a reduced size wear plate 38*a*. Wear plate 38*a* includes the plurality of apertures 40*a* adapted to receive bolts 58*a* therein, outlet port 22*a*, drive shaft bore 66*a* adapted to receive drive shaft 29*a* therein, and communication port

27*a*. A longitudinally extending channel 126 provides fluid communication between communication port 27*a* and drive shaft bore 66*a* when pump 10*a* is in operation.

Hydraulic pump assembly 10 provides a greatly improved pump efficiency by eliminating the need for mechanical elements and/or retention devices such as retaining rings to attach gears 112 and 114 to shafts 32 and 34. By eliminating the need for retaining rings, pump elements 28 and 30 of pump assembly 10 are able to maintain a sufficiently large leak path 120 for a relatively smaller size of pump elements 28 and 30 and overall size of the associated pump 10 for a given set of operational parameters. Further, pump assembly 10 is more economical to produce, maintain and repair, and is particularly well adapted to applications requiring pumps of reduced size.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A hydraulic pump assembly, comprising:

a pump housing having a chamber defined therein, the chamber including a pair of cylindrically shaped portions each defining at least one end wall, the housing including an inlet port and an outlet port in fluid communication with the chamber; and wherein the housing further includes at least one circulation port in fluid communication with at least one of the cylindrically shaped portions of the chamber;

a pair of rotary pump elements disposed for rotation within the cylindrically shaped portions of the chamber, wherein the pair of pump elements cooperate to create a hydraulic pressure; and a pair of cylindrically shaped shafts each having at least one end face, the shafts disposed within the pair of cylindrically shaped portions of the chamber and within the pair of pump elements, the shafts fixed for rotation and axially shiftable with respect to the pump elements;

wherein a hydraulic fluid within the chamber stabilizes at least one of the axially shiftable shafts such that the end face of the shaft is spaced from the associated end wall of the cylindrically shaped portion of the chamber when the hydraulic pump assembly is in use.

2. The hydraulic pump assembly of claim 1, wherein the circulation ports are configured to optimize a hydraulic pressure within the chamber.

3. The hydraulic pump assembly of claim 2, wherein each of the shafts define a longitudinal axis, each of the cylindrically shaped portions of the chamber is in fluid communication with one of the circulation ports, and wherein each circulation port is offset from a longitudinal axes of the shafts.

4. The hydraulic pump assembly of claim 3, wherein the hydraulic pump further includes an intermediate shaft, the pair of shafts includes a first shaft and a second shaft, the first shaft having a first end and a second end, and wherein the first end of the first shaft is hingedly coupled with the drive shaft.

5. The hydraulic pump assembly of claim 4, wherein the first shaft is linearly movable with respect to the intermediate shaft.

6. The hydraulic pump assembly of claim 5, wherein intermediate shaft has a C-shaped cross-sectional geometry that receives the drive shaft therein.

7. The hydraulic pump assembly of claim 6, wherein the housing includes a first section that includes a portion of each of the cylindrically shaped portions of the chamber, and a second section that includes a portion of each of the cylindrically shaped portions of the chamber.

8. The hydraulic pump assembly of claim 7, wherein the pump elements include gears each having a plurality of cooperating teeth.

9. A hydraulic pump assembly, comprising:

a pump housing having a chamber defined therein, the chamber including a pair of cylindrically shaped portions each defining at least one end wall, the housing including an inlet port and an outlet port in fluid communication with the chamber;

a pair of rotary pump elements disposed for rotation within the cylindrically shaped portions of the chamber, wherein the pair of pump elements cooperate to create a hydraulic pressure; and a pair of cylindrically shaped shafts each having at least one end face, wherein at least one of the end faces of the shafts is rounded, the shafts disposed within the pair of cylindrically shaped portions of the chamber and within the pair of pump elements, the shafts fixed for rotation and axially shiftable with respect to the pump elements;

wherein a hydraulic fluid within the chamber stabilizes at least one of the axially shiftable shafts such that the end face of the shaft is spaced from the associated end wall of the cylindrically shaped portion of the chamber when the hydraulic pump assembly is in use, and wherein each of the shafts define a longitudinal axis, each of the cylindrically shaped portions of the chamber is in fluid commination with one of the circulation ports, and wherein each circulation port is offset from the longitudinal axes of the shafts, thereby allowing hydraulic fluid to escape from the cylindrically shaped portions of the chamber via the circulation ports when the end faces of the shafts are in contact with the end walls of the cylindrically shaped portions of the chamber.

10. A hydraulic pump assembly, comprising:

a pump housing having a chamber defined therein, the chamber including a pair of cylindrically shaped portions each defining at least one end wall, the housing including an inlet port and an outlet port in fluid communication with the chamber:

a pair of rotary pump elements disposed for rotation within the cylindrically shaped portions of the chamber, wherein the pair of pump elements cooperate to create a hydraulic pressure;

a pair of cylindrically shaped shafts each having at least one end face, the shafts disposed within the pair of cylindrically shaped portions of the chamber and within the pair of pump elements, the shafts fixed for rotation and axially shiftable with respect to the pump elements, the pair of cylindrically shaped shafts includes a first shaft and a second shaft, the first shaft having a first end and a second end; and an intermediate shaft wherein the first end of the first shaft is hingedly coupled with the intermediate shaft, the first shaft is translationally coupled with the intermediate shaft, and wherein the intermediate shaft has a notched end having a rectangularly-shaped cross-sectional geometry that receives the drive shaft therein;

wherein a hydraulic fluid within the chamber stabilizes at least one of the axially shiftable shafts such that the end face of the shaft is spaced from the associated end wall of the cylindrically shaped portion of the chamber when the hydraulic pump assembly is in use.

11. A hydraulic pump assembly, comprising:

a pump housing having a chamber defined therein, the housing including an inlet port, an outlet port and at least one circulation port in fluid communication with the chamber, the chamber including a pair of cylindrically shaped portions each having at least one end wall wherein the circulation ports are configured to optimize a hydraulic pressure within the cylindrically shaped portions of the chamber;

a pair of rotary pump elements each having a central bore extending therethrough and a plurality of meshing teeth, the pump elements disposed for rotation within the chamber, the pair of pump elements cooperating to create a hydraulic pressure within a portion of the chamber; and a pair of cylindrically shaped shafts each having at least one end face, the shafts disposed within the chamber and within the central bores of the pump elements, the shafts fixed for rotation and linearly translatable with respect to the pump elements;

wherein a hydraulic fluid within the hydraulic pump assembly stabilizes at least one linearly translatable shaft such that the end face of the shafts is spaced apart from the associated end wall of the cylindrically shaped portions of the chamber when the pump assembly is in use.

12. A hydraulic pump assembly, comprising:

a pump housing having a chamber defined therein, the housing including an inlet port, an outlet port and at least one circulation port in fluid communication with the chamber, the chamber including a pair of cylindrically shaped portions each having at least one end wall;

a pair of rotary pump elements each having a central bore extending therethrough and a plurality of meshing teeth, the pump elements disposed for rotation within the chamber, the pair of pump elements cooperating to create a hydraulic pressure within a portion of the chamber; and a pair of cylindrically shaped shafts each having at least one end face, the shafts disposed within the chamber and within the central bores of the pump elements, the shafts fixed for rotation and linearly translatable with respect to the pump elements wherein at least one of the end faces of the shafts is rounded;

wherein a hydraulic fluid within the hydraulic pump assembly stabilizes at least one linearly translatable shaft such that the end face of the shafts is spaced apart from the associated end wall of the cylindrically shaped portions of the chamber when the pump assembly is in use, and wherein each of the shafts defines a longitudinal axis, each of the cylindrically shaped portions of the chamber houses one of the shafts therein, and wherein each circulation port is offset from the longitudinal axes of the shafts, thereby allowing hydraulic fluid to escape from the cylindrically shaped portions of the chamber via the circulation ports when the end faces of the shafts are in contact with the end walls of the cylindrically shaped portions of the chamber.

13. A hydraulic pump assembly, comprising:

a pump housing having a chamber defined therein, the housing including an inlet port, an outlet port and at least one circulation port in fluid communication with the chamber, the chamber including a pair of cylindrically shaped portions each having at least one end wall;

a pair of rotary pump elements each having a central bore extending therethrough and a plurality of meshing teeth, the pump elements disposed for rotation within the chamber, the pair of pump elements cooperating to create a hydraulic pressure within a portion of the chamber;

a pair of cylindrically shaped shafts each having at least one end face, the shafts disposed within the chamber and within the central bores of the pump elements, the shafts fixed for rotation and linearly translatable with respect to the pump elements, the pair of cylindrically shaped shafts includes a first shaft and a second shaft, the first shaft having a first end and a second end; and an intermediate shaft wherein the first end of the first shaft is hingedly coupled with the intermediate shaft, the first shaft is translationally coupled with the intermediate shaft, and wherein the intermediate shaft has a notched end having a rectangularly-shaped cross-sectional geometry that receives the drive shaft therein;

wherein a hydraulic fluid within the hydraulic pump assembly stabilizes at least one linearly translatable shaft such that the end face of the shafts is spaced apart from the associated end wall of the cylindrically shaped portions of the chamber when the pump assembly is in use.

* * * * *